US006913474B2

(12) United States Patent
Mikhail et al.

(10) Patent No.: US 6,913,474 B2
(45) Date of Patent: Jul. 5, 2005

(54) CONNECTOR COUPLING MECHANISM, SYSTEM AND METHOD

(75) Inventors: Amanda Elisa Mikhail, Rochester, MN (US); Ray Clement Laning, Rochester, MN (US); Christopher Michael Marroquin, Rochester, MN (US); Scott Alan Shurson, Mantorville, MN (US); Brian Joseph Stanczyk, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/285,229

(22) Filed: Oct. 31, 2002

(65) Prior Publication Data

US 2004/0087193 A1 May 6, 2004

(51) Int. Cl.[7] ..... H01R 13/62
(52) U.S. Cl. ..... 439/157
(58) Field of Search ..... 439/157, 153, 439/460, 468, 471–473

(56) References Cited

U.S. PATENT DOCUMENTS 5,299,944 A * 4/1994 Larabell et al. ..... 439/157
5,322,448 A * 6/1994 Hahn ..... 439/157
6,293,813 B1 * 9/2001 Johnston et al. ..... 439/157
6,540,546 B2 * 4/2003 Kubo ..... 439/468

* cited by examiner

*Primary Examiner*—Renee Luebke
(74) *Attorney, Agent, or Firm*—Leslie J. Payne

(57) ABSTRACT

A connector coupling mechanism comprises a housing coupled to a first connector; and, a force applying device connected to the housing and being movable between docking and undocking positions; wherein in response to the force applying device moving to the docking position, a mechanical advantage is provided for facilitating a firm coupling of the first and second connector assemblies. In addition, the force applying device provides a mechanical advantage in response to the force applying device moving to undocking position for facilitating easy unplugging. The coupling mechanism provides a latching arrangement for releasable and positive retention of the force applying device in the docked position for preventing against inadvertent unplugging. A connector assembly coupling system is provided as well as a method of coupling connector assemblies.

15 Claims, 5 Drawing Sheets

CONNECTOR COUPLING MECHANISM, SYSTEM AND METHOD

BACKGROUND OF THE INVENTION

The present invention relates generally to a coupling mechanism for use in coupling together connector assemblies. More particularly, the present invention relates to an improved coupling mechanism that greatly facilitates docking and undocking with the aid of mechanical advantage as well as positively retaining mated connector assemblies.

Cables typically include an electronic connector assembly at opposing ends that are matable with a corresponding connector assembly associated with electronic devices. Such cable connector assemblies are well known in the connector assembly art and include a universal serial bus (USB)-type connector assembly, a parallel connector assembly, a serial connector assembly, and the like.

Cable connector assembly coupling systems are generally employed to reduce the likelihood that a cable connector assembly will be unintentionally unplugged or decoupled from a connector assembly port; thus insuring continuous electrical coupling of associated printed circuit boards to each other.

In computer systems, for example, cables having connector assemblies at each end are utilized for reliably and releaseably coupling a cable or the like between a first circuit board assembly and a second circuit board assembly. Heretofore, connector assemblies are typically mounted on these boards and cooperate with respective connector assembly ends of the cable for facilitating coupling of these connector assembly ends in a docked relationship. For example, such interconnections have multiple pins on one connector assembly matable with complementary sockets on another connector assembly. However, such pins and sockets are constructed whereby they can be relatively easily damaged if not guided properly during docking and undocking. It is important, therefore, to insure that the mating components are properly aligned in order to avoid damaging the pins, such as by stubbing or bending them, during docking. In addition, it is highly desirable to minimize unbalanced forces being applied during docking that might otherwise result in damage to the mating pin and socket components due to misalignment and misguidance. Moreover, the balanced application of docking forces is also desirable as well, since unbalanced forces might otherwise result in connector assembly misalignments, thereby resulting in incomplete plugging, whereby damage to connection integrity results.

Moreover, these kinds of connector assemblies typically require relatively high application forces for effecting their desired coupling. Some connector assemblies in computer systems require relatively significant manual docking forces for effecting a stable connection due to the type of high insertion type connector assemblies being used (e.g., VHDM, HDM, and FUTUREBUS connections}. Consequently, it will be appreciated that it is desirable to minimize the forces necessary for effecting coupling so as to ease installation forces by users, thereby not having to apply excessive docking and undocking forces. A further disadvantage associated with high installation and removal forces required to dock and undock are that such forces might inadvertently contribute to damaging delicate pin components and the like. Clearly, damaged connections undermine operational integrity of a computer system. It is also highly desirable to positively retain the components in their docked condition for minimizing any tendency of them becoming uncoupled.

Without the ability of reliably and expeditiously interconnecting cable connector assemblies in a manner that facilitates their docking and undocking while affording the ability of positively and releaseably retaining the connector assemblies coupled, the true potential of such couplings will not be realized.

SUMMARY OF THE INVENTION

In regard to achieving the foregoing aspects and further in regard to improving over the prior art especially in connection with the issues raised above, the present invention makes provision for a coupling mechanism for use in coupling a first connector assembly associated with a cable to a second connector assembly. The coupling mechanism comprises: a housing assembly coupled to and at least partially housing the first connector assembly; and, a force applying device connected to the housing assembly and being movable between docking and undocking positions; wherein in response to the force applying device moving to the docking position a mechanical advantage to an applying force is developed for facilitating a firm coupling of the first and second connector assemblies.

In another illustrated embodiment, the coupling mechanism, in response to the force applying device being moved to the undocking position develops a mechanical advantage to an applying force for effecting an uncoupling of the first and second connector assemblies.

In another illustrated embodiment, the housing assembly provides for at least one guidance unit that cooperates with a fixed complementary structure associated with the second connector assembly for pre-aligning the first and second connectors before docking. In such an illustrated embodiment, the guidance unit includes a guide channel for cooperating with an element.

In a still further illustrated embodiment, the coupling mechanism of the type noted includes a pair of first and second segments at each distal end of the force applying device. The first and second segments are angularly spaced apart with respect to each other and provide for selective engagement with respective surfaces of a fixed structure associated with the second connector assembly for assisting in providing for the mechanical advantages used for docking and undocking; respectively.

In yet another illustrated embodiment of the present invention, the coupling mechanism provides a latching arrangement for positively and releaseably latching at least one end portion of the force applying device in the docking position to thereby prevent against inadvertent unplugging. In such an embodiment, the housing assembly includes a resiliently deformable portion which when deformed by forces being applied thereto release the latching arrangement.

In still another preferred embodiment, a connector assembly coupling system comprises: a cable having a first connector assembly at an end thereof; a second connector assembly and a mounting structure for the second connector assembly; and, a coupling mechanism of kind described above for use in coupling the first connector assembly to the second connector assembly.

Yet further embodiments include a computer system employing the noted connector assembly coupling system as well as an improved method of coupling together the first and second connector assemblies.

It is an aspect of the present invention to provide a coupling mechanism for use in coupling together first and second connector assemblies.

It is yet another aspect of the present invention to enhance the guidance, retention, and ease of docking and undocking of the coupling mechanism in a compact construction.

It is another aspect of the present invention to provide a coupling mechanism for greatly facilitating docking and undocking with the aid of mechanical advantage as well as for positively retaining connector assemblies so as to protect against their inadvertent unplugging.

It is another aspect of the present invention to provide a coupling mechanism of the foregoing type that enhances proper guidance between pins and sockets of mating connector assemblies in addition to the positive retention of such mated connector assemblies in a mated condition; whereby the connections will not inadvertently unplug.

DETAILED DESCRIPTION

Figure 1:
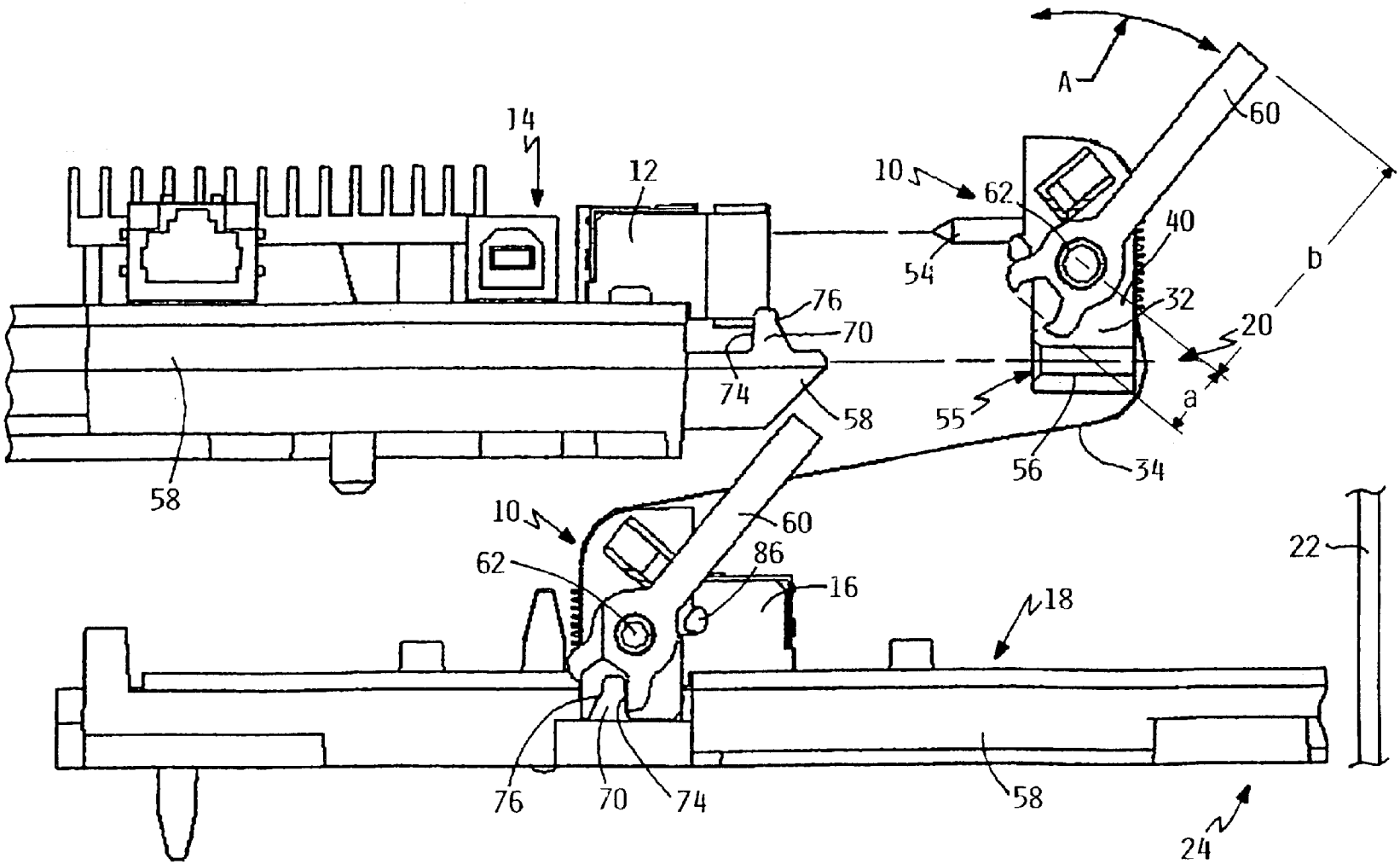
FIG. 1 is an elevation view of an improved connector assembly coupling system made according to the present invention in an undocked condition.

Reference is made to FIGS. 1–5 for illustrating one preferred embodiment of a connector assembly coupling mechanism or coupling mechanism made according to the present invention and which is generally designated by reference numeral 10. The coupling mechanism 10 is particularly adapted for use in releaseably coupling together an electrical connector assembly 12 on a first circuit board assembly 14 to an electrical connector assembly 16 on a second circuit board assembly 18 for use in a connector assembly coupling system 20. For example, the circuit board assemblies 14, 18 are illustrated as being within a chassis 22, only a portion of which is shown, of a computer system 24. It will be understood that the coupling mechanism 10 can be used in a variety of different environments wherein it is desirable to releaseably retain a cable to and between different electrical connector assemblies.

In an exemplary embodiment, the coupling mechanism 10 includes a connector assembly housing assembly 32, preferably, at each end of a flex cable 34. The flex cable 34 is electrically coupled to the connector assembly housing assembly 32, as will be described hereafter. While a flex cable is illustrated, it will be appreciated that the present invention is not limited to such a cable, but embraces a wide variety of electrical cables and the like. Since both the coupling mechanisms 10 are substantially similar, a description of only one is presented hereinafter.

Essentially, the coupling mechanism 10 functions to house and firmly secure a connector assembly 36, for example a VHDM connector assembly, or other similar device attached to one end portion of the flex cable to a complementary connector assembly 12, such as mounted on the circuit board 14. The connector assemblies 12, 36 are known in the connector assembly art and can be of the electronic or fiber optic type. For instance, some common electronic connector assemblies include, for example, universal serial bus (USB)-type connector assemblies, parallel connector assemblies and serial connector assemblies. Common fiber optic connector assemblies include, for example, LC, ST, SC, and MTP optical connector assemblies (also known as MPO connector assemblies). In addition, the present invention contemplates that the principles thereof can be applied to other kinds of connector assemblies as yet developed.

Figure 4:
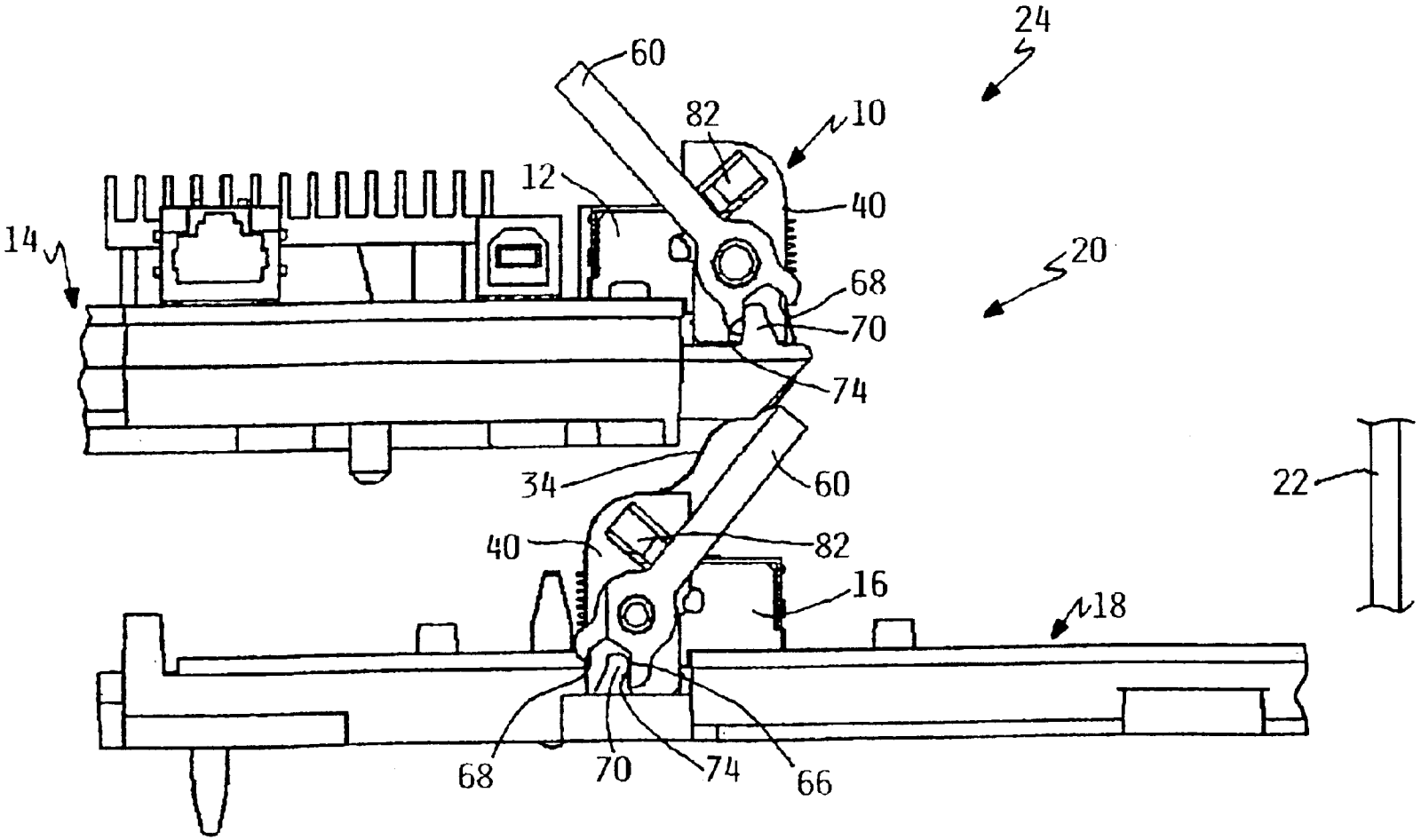
FIG. 4 is an elevation view of an improved coupling mechanism made according to the present invention in a docked condition.

Continued reference is made to FIGS. 1–5 for illustrating one preferred embodiment of the present invention. It will be appreciated that the illustrated embodiment can have a variety of configurations and that the illustrated preferred embodiment is but one example. In the exemplary embodiment, the connector assembly housing 32 is formed from a commercially available non-conductive and flexibly resilient plastic material, such as Ultem 1000 or the like. The present invention contemplates that other similar materials can be used. The connector assembly housing assembly 32 includes upstanding side walls 40 joined by a back wall having a curved upper portion and an inwardly protruding connector assembly ledge 44 (FIG. 3) at a lower portion upon which the VHDM connector assembly 36 rests. The VHDM connector assembly 36 is accommodated inside of the connector assembly housing 32 while being electrically and mechanically coupled through an opening (not shown) to the flex cable 34, such as by soldering or the like. The flex cable 34 is secured to the connector assembly housing assembly 32, such as illustrated in FIGS. 1&4, as by adhesives, conventional fasteners (not shown) or the like.

The VHDM connector assembly 36 as is well known includes a connector assembly segment having wall portion mounting pins 50 for reception in sockets (not shown) of the connector assembly 12. While this embodiment discloses a given male/female orientation, the present invention contemplates other kinds of matable configurations. It will be noted that the pins and corresponding sockets are made typically of structure that is somewhat fragile, such as thin metal, and if not handled properly can be damaged, such as during installation when typically high manual forces are required to effect a positive coupling action. The VHDM connector assembly 36 can have a pair of parallel and spaced apart alignment pins 54 extending therefrom that are particularly sized and shaped for slidable receipt within complementary shaped openings (not shown) in the connector assembly 12. The alignment provided by the alignment pins 54 is important from the standpoint of assisting in providing a connection in which potential damage to the mating components caused by misalignment is minimized. Further, towards this particular end, the connector assembly housing 32 includes a pair of laterally disposed guidance units 55, each being defined by block constructions and each defining a generally U-shaped guide channel 56. Each of the guidance units 55 functions to slidably cooperate with a complementary shaped fixed guidance rib-shaped track portion (not shown) formed on the board stiffener 58 for assisting in proper pre-alignment of the alignment pins prior to the docking installation. Various kinds of alignment arrangements are all within the scope of this invention.

A force applying device 60 in the present embodiment is represented by a generally U-shaped handle 60 that is pivotally mounted at opposite ends on the stub shafts 62. The shafts 62 extend from the walls 40 and are coaxially aligned for defining a rotational axis 67 (FIG. 3) about which the force applying handle 60 rotates. The force applying handle 60 has a configuration that advantageously allows mating forces to be applied generally evenly along the axial extent of the mating connector assembly portions. Clearly, other handle configurations are contemplated for use. A pair of spaced apart force applying segments 66, 68 is formed at each distal end portion of the handle 60. The segments 66, 68 are constructed and angularly spaced apart with respect to each other as illustrated and are mounted to engage and interconnect with a docking/undocking element 70 that is a fixed structure on the board stiffener 58. In the illustrated embodiment, the docking/undocking element 70 is upstanding and generally rounded as depicted. Essentially, the docking/undocking element 70 includes docking and undocking portions 74, 76; respectively, on opposing sides thereof. For example, as the handle 60 of the uppermost (as viewed in the drawings) assembly housing 32 pivots, the segments 66, 68 ride over the docking/undocking element 70 and cooperate so that the segments 66 ride over the docking portions 74 in order to facilitate the connector assembly housing assembly being forced into a mating relationship with the connector assembly. The cooperation between the segment 66 of the handle and the docking portion 74 advantageously assists in providing for a mechanical advantage for enhancing a firm docking of the connector assemblies and thereby providing a sound electrical interconnection in response to the handle being rotated to the docking position. The degree of mechanical advantage can be varied in known fashion. In this regard, the ratio of the length "b" (FIG. 1) of the handle arm from its horizontal gripping portion rip to the stub shaft relative to the length "a" (FIG. 1) of the segments from the stub shaft is varied.

Figure 2:
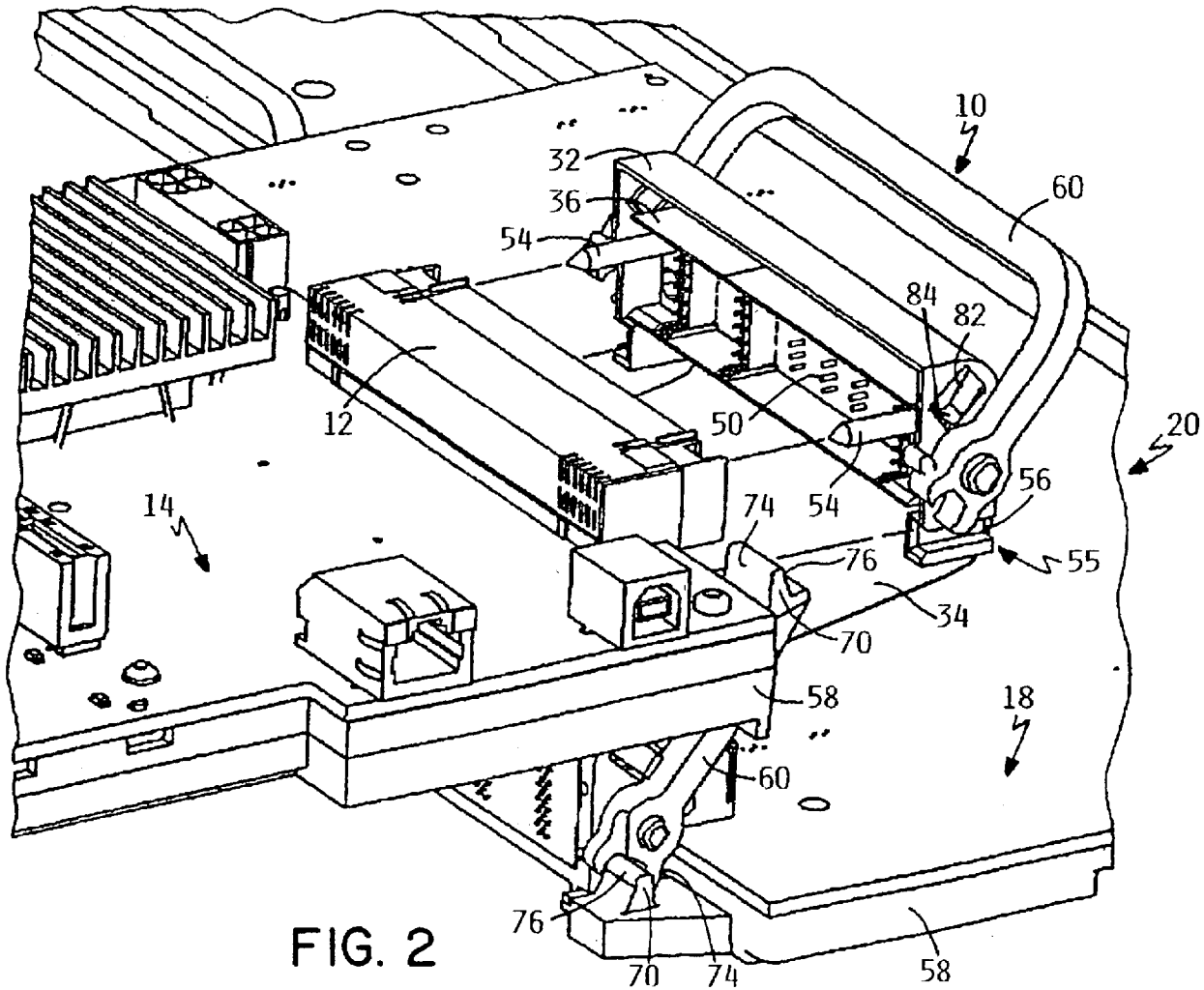
FIG. 2 is a perspective view similar to FIG. 1, illustrating a portion of the coupling mechanism of the system in an undocked condition.
Figure 3:
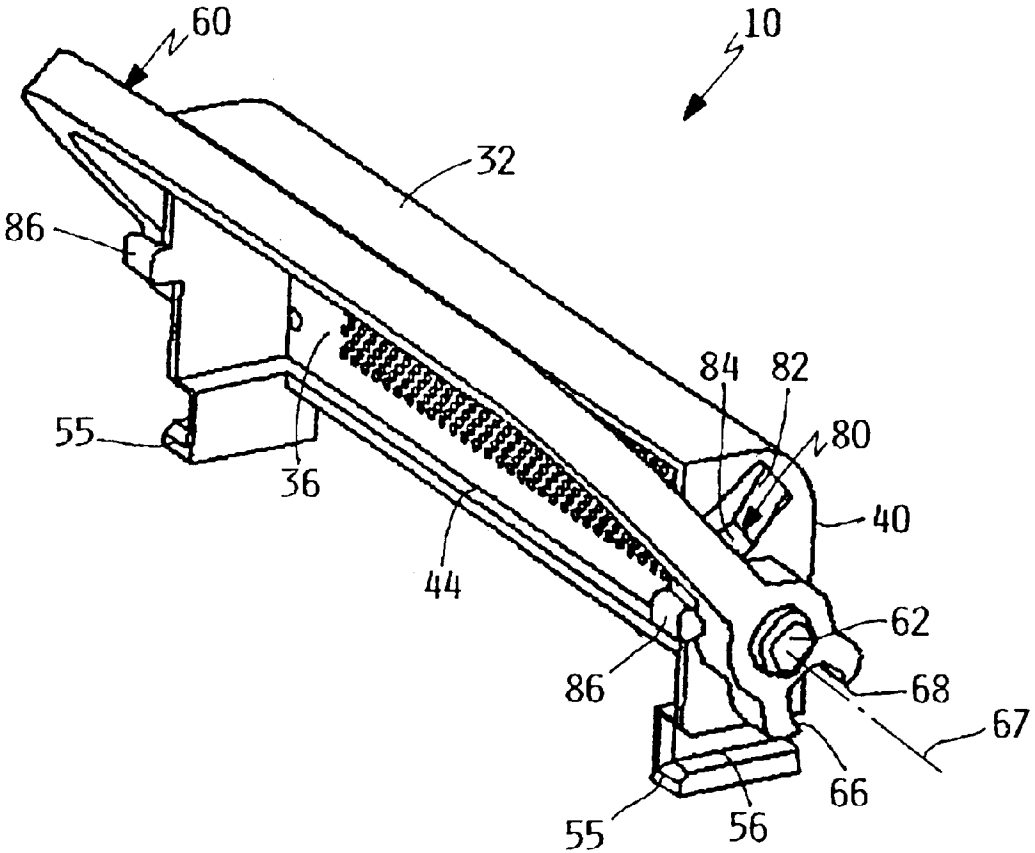
FIG. 3 is a perspective view of a coupling mechanism made according to the principles of the present invention.
Figure 5:
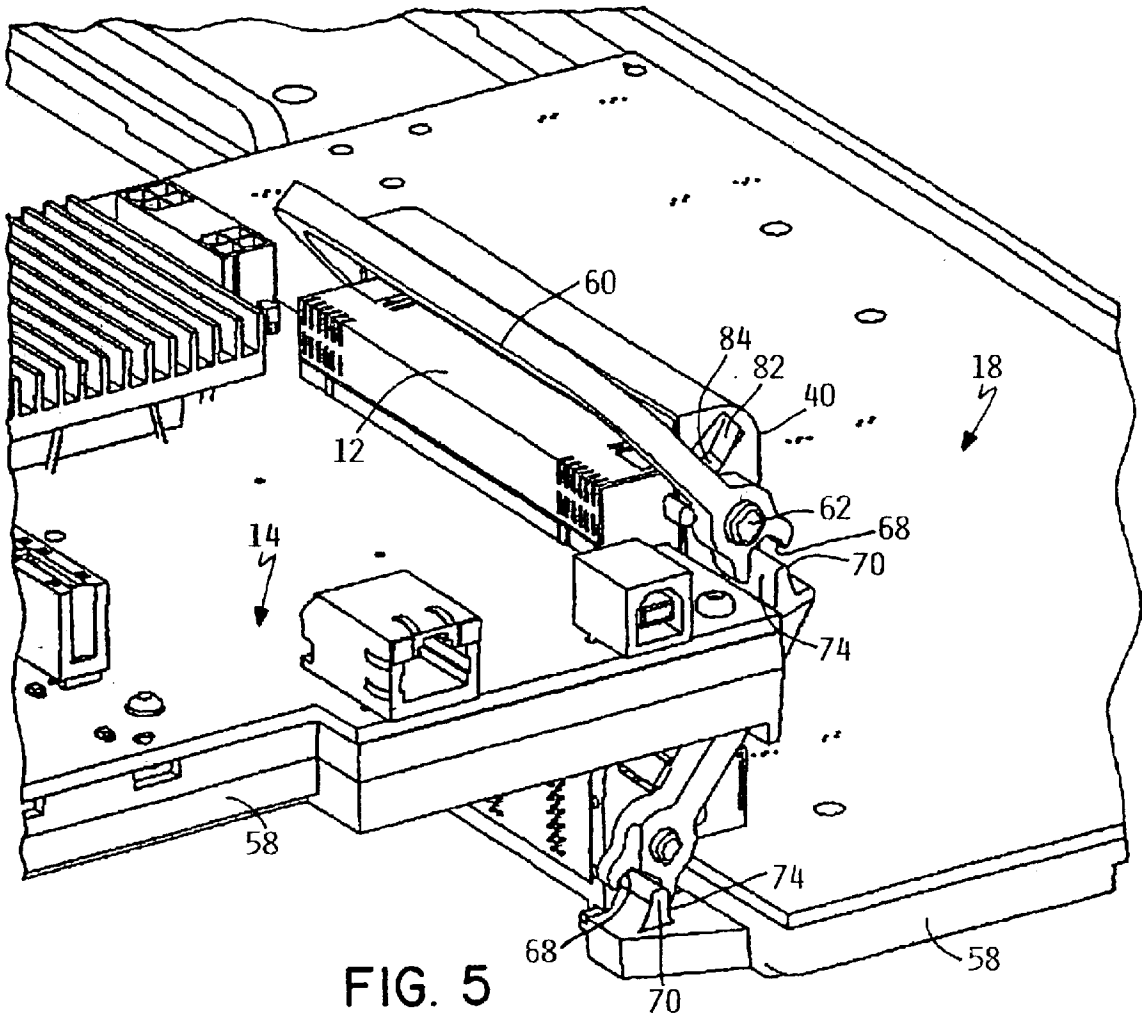
FIG. 5 is a perspective view similar to FIG. 4, illustrating a portion of a coupling mechanism in a docked condition.

FIGS. 2 & 5 illustrate a pair of exemplary raised retention elements 80 for advantageously providing for a latching arrangement as will be discussed. Each of the raised retention elements 80 extend from an opposing end wall 40 for latching with the force applying handle 60 in order to retain the latter in the insertion or docking position; as will be explained. As a consequence, the mated electrical coupling or connection between the connector assemblies can be positively maintained throughout use; thereby lessening undesired disengagements of the mating connection. In an exemplary embodiment, the raised retention element 80 includes an inclined ramp 82 and a retention shoulder 84; the latter of which advantageously retains the handle 60 from moving away from the retention position (FIGS. 4 & 5). The inclined ramp 82 is constructed to allow the handle 60, as the latter rides on the inclined ramp, to slightly deflect the end retention elements 80 inwardly, as viewed in the drawing, whereby such elements will return from the deflected condition to retain the handle in the retention position as docked. While in this embodiment the end walls are resiliently deflectable, it will be appreciated that the handle can be deflectable as well for releasing the latching effect created. Of course, other known latching structures can be provided. A pair of stop members 86 is provided on an edge of the housing 32 for contact with each handle end portion for inhibiting further rotation, thereby preventing over rotation of the handle and the ensuing application of too much force being applied to the mating connections by an operator forcing the handle.

For disengaging the connector assemblies, an operator squeezes the retention elements 80 of the housing 32 inwardly, whereby the retention shoulders 84 no longer acts to inhibit the handle from being rotated by a user to the undocking position. As a result, the connector assemblies can be separated by relatively easily pulling them apart during an undocking operation. Because of the mechanical advantages provided by the handle the uncoupling action is reliably and easily facilitated.

The embodiments and examples set forth herein were presented to best explain the present invention and its practical applications and to thereby enable those skilled in the art to make and use the invention. However, those skilled in the art will recognize that the foregoing description and examples have been presented for the purposes of illustration and example only. The description set forth is not intended to be exhaustive or to limit the invention to the precise forms disclosed. Many modifications and variations are possible in light of the above teachings without departing from the spirit and scope of the appended claims.

What is claimed is:

1. A coupling mechanism for use in coupling a first connector assembly associated with a cable to a second connector assembly; the coupling mechanism comprising:

a housing assembly coupled to and at least partially housing the first connector assembly; and, a force applying device connected to the housing assembly and being movable between docking and undocking positions;

wherein in response to the force applying device moving to the docking position a mechanical advantage to an applying force is developed for facilitating a firm coupling of the first and second connector assemblies; and wherein the force applying device, in response to being moved to the undocking positions develops a mechanical advantage to an applying force for effecting an easy uncoupling of the first and second connector assemblies; wherein the force applying device includes a pair of first and second segments at a distal end thereof, the first and second segments are angularly spaced apart with respect to each other and each provides for selective engagement with a respective opposing surface of a corresponding fixed structure separate and apart from the second connector assembly for assisting in providing for the mechanical advantages for docking and undocking; respectively.

2. The coupling mechanism of claim 1 wherein the force applying device is a handle that is mounted on the housing assembly for pivoting movement between the docking and undocking positions.

3. The coupling mechanism of claim 1 wherein the housing assembly provides for at least one guidance unit that cooperates with a corresponding fixed complementary structure associated with the second connector assembly for pre-aligning the connector assemblies before docking.

4. The coupling mechanism of claim 3 wherein each of a pair of guidance units includes a guide channel.

5. The coupling mechanism of claim 1 further comprising a latching arrangement on at least one portion of the housing assembly for releaseably and positively latching the force applying device in the docking position, thereby preventing against unplugging.

6. The coupling mechanism of claim 5 wherein the housing assembly includes a resiliently deformable portion which when deformed by forces being applied thereto releases the at least one latching arrangement.

7. A system for coupling a first connector assembly to a second connector assembly, the system comprising:

a cable having a first connector assembly at one end thereof and a second connector assembly at an opposite end thereof;

a third connector assembly mounted on a first mounting structure; and, a fourth connector assembly mounted on a second mounting structure; and, a coupling mechanism for each of the first and second connector assemblies for use in coupling the first and second connector assemblies to the respective third and fourth connector assemblies; each of the coupling mechanisms including:

a housing assembly coupled to and at least partially housing one of the first or second connector assemblies; and, a force applying device connected to the housing assembly and being movable between docking and undocking positions; wherein in response to the force applying device moving to the docking position a mechanical advantage to an applying force is developed for facilitating a firm coupling; and wherein the force applying device in response to being moved to the undocking position develops a mechanical advantage to an applying force for effecting an easy uncoupling; further wherein the force applying device includes a pair of first and second segments at a distal end thereof, the first and second segments are angularly spaced apart with respect to each other and each provides for selective engagement with a respective opposing surface of a corresponding fixed structure separate and apart from the second connector assembly for assisting in providing for the mechanical advantages for docking and undocking; respectively.

8. The system of claim 7 wherein the force applying device is a handle that is mounted on the housing assembly for pivoting movement between the docking and undocking positions.

9. The system of claim 7 further comprising at least one guidance unit on each of the housing assemblies that cooperates with a respective fixed complementary structure for pre-aligning of the housing assemblies before docking.

10. The system of claim 7 further comprising at least one latching arrangement on each of the housing assemblies for releaseably retaining a respective one of the force applying devices in the docking position thereby positively retaining against inadvertent unplugging.

11. The system of claim 10 wherein each of the housing assemblies includes a resiliently deformable portion which when deformed by forces being applied thereto releases the at least one latching arrangement.

12. A computer system comprising:

a cable having a first connector assembly at one end thereof and a second connector assembly at the opposite end thereof;

a third connector assembly on a first circuit board assembly;

a fourth connector assembly on a second circuit board assembly; and, a coupling mechanism associated with each end of the first and second connector assemblies;

one of the coupling mechanisms for use in coupling the first connector assembly to the third connector assembly, and the other coupling mechanism for coupling the second connector assembly to the fourth connector assembly; each of the coupling mechanisms comprises:

a housing assembly coupled to and at least partially housing the first or second connector assembly; and, a force applying device connected to each of the housing assemblies and being movable between docking and undocking positions; wherein in response to the force applying device moving to the docking position a mechanical advantage to an applying force is developed; and, wherein the coupling mechanism in response to the force applying device being moved to the undocking position applies a mechanical advantage to an applying force for effecting an uncoupling of the first and second connector assemblies; further wherein the force applying device includes a pair of first and second segments at a distal end thereof, the first and second segments are angularly spaced apart with respect to each other and each provides for selective engagement with a respective opposing surface of a corresponding fixed structure separate and apart from the second connector assembly for assisting in providing for the mechanical advantages for docking and undocking; respectively.

13. The computer system of claim 12 further comprising a latching arrangement on each of the coupling mechanisms on at least one portion of the housing assembly of each housing for releaseably and positively latching the force applying device in the docking position.

14. A method of coupling a first connector assembly to a second connector assembly, the method comprising the steps of:

providing a cable having a first connector assembly at one end thereof;

providing a second connector assembly mountable on a mounting structure;

providing a coupling mechanism for use in coupling the first connector assembly to the second connector assembly, wherein the coupling mechanism includes:

a housing assembly coupled to and at least partially housing the first connector assembly; and, a force applying device connected to the housing assembly and being movable between docking and undocking positions; further wherein the force applying device includes pair of first and second segments at a distal end thereof, the first and second segments are angularly spaced apart with respect to each other and each provides for selective engagement with a respective opposing surface of a corresponding fixed structure separate and apart from the second connector assembly for assisting in providing for the mechanical advantages for docking and undocking; respectively, docking the first and second connector assemblies after being aligned in response to the force applying device moving to the docking position by developing a mechanical advantage to an applying force for facilitating a firm coupling of the first and second connector assemblies wherein the first segment engages a surface of a corresponding fixed structure separate and apart from the second connector assembly for assisting in providing for the mechanical advantages for docking; and, undocking the first and second connector assemblies in response to moving the force applying device to the undocking position wherein the second segment engages a surface of the corresponding fixed structure separate and apart from the second connector assembly whereby a mechanical advantage to an applying force for facilitating an uncoupling of the first and second connector assemblies.

15. The method of claim 14 further comprising the step of: positively and releaseably retaining the force applying device In the docking position.

* * * * *